United States Patent [19]

Ali-Zade et al.

[11] Patent Number: 4,901,805

[45] Date of Patent: Feb. 20, 1990

[54] UNIT FOR BOREHOLE RUNNING AND PULLING OPERATIONS

[75] Inventors: Vagif A. Ali-Zade; Eldar Tarik ogly Zeinalov; Nariman Gusein Kuli ogly Kurbanov; Vladimir A. Kartashev, all of Baku, U.S.S.R.

[73] Assignee: Nauchno-Issledovatelsky I Proektno-Konstructorsky Institut Neftyanogo Mashinostroenia, Baku, U.S.S.R.

[21] Appl. No.: 230,991

[22] Filed: Aug. 11, 1988

[30] Foreign Application Priority Data

Aug. 17, 1987 [SU] U.S.S.R. ..... 4296684

[51] Int. Cl.[4] ..... E21B 19/20

[52] U.S. Cl. ..... 175/85; 175/52; 175/170; 414/22.51

[58] Field of Search ..... 175/85, 52, 170; 166/77.5; 414/22, 22.51, 22.61

[56] References Cited

U.S. PATENT DOCUMENTS 2,946,464 7/1960 Guier ..... 214/2.5
3,929,235 12/1975 Howard et al. ..... 214/2.5
4,591,006 5/1986 Hutchison et al. ..... 175/85

FOREIGN PATENT DOCUMENTS 574517 9/1977 U.S.S.R. .
588340 4/1978 U.S.S.R. .
945360 7/1982 U.S.S.R. .

*Primary Examiner*—Jerome W. Massie, IV
*Assistant Examiner*—Terry Lee Melius
*Attorney, Agent, or Firm*—Fleit, Jacobson, Cohn, Price, Holman & Stern

[57] ABSTRACT

The unit for borehole running and pulling operations with drill pipes or rods has its centralizer mounted for vertical reciprocation along guides and horizontal displacement along guideways in the opening of the racking platform in its cooperation with the traveling block. The guides for vertical reciprocation of the centralizer are rigid and provided with stops, and each guideway for horizontal displacement of the centralizer is in the form of either a plate with a slot, or a beam mounted for its introduction into and withdrawal from the opening of the racking platform.

7 Claims, 11 Drawing Sheets

UNIT FOR BOREHOLE RUNNING AND PULLING OPERATIONS

FIELD OF INVENTION

The present invention relates to oil and gas field equipment and, more particularly, to units for borehole running and pulling operations with drill rods or pipes.

The invention is intended for employment in mobile and stationary installations for drilling or servicing boreholes or wells, with vertical racking of drill pipes and vertical suspension of drill rods.

BACKGROUND OF THE INVENTION

Mobile pipe and rod handling units generally incorporate inclined telescoping masts to limit the weight and dimensions of a unit and to provide for its transportability and for the complicated routine of positioning the unit at the wellhead or the mouth of a borehole. The use of known technical solutions in such handling units applies some additional requirements as regards both the design of the components of the units and the procedure of conducting running and pulling operations.

A topical issue in the drilling of boreholes and servicing of wells is enhancing labor productivity, cutting the time of pipe- and rod-pulling/running operations, and of mounting and dismantling of the unit at a borehole or well. The major possibility for significantly cutting the time of running/pulling operations is offered by overlapping the operations of pipe- or rod-running/pulling and the operations of their coupling/uncoupling and handling. The known units with overlapping of these operations are intended practically exclusively for the drilling of boreholes, and are incorporable only in stationary drilling rigs, as their use in mobile handling units with an inclined mast is prohibited for a number of reasons: they are too heavy and bulky, and their complicated structure involves considerable input of both time and effort for the mounting/dismantling and adjustments of the unit.

There is known a drilling rig (U.S. Pat. No. 3929235) incorporating a system for mechanization of pulling and running operations. The rig comprises a stationary derrick, crown pulley, travelling block with a pipe elevator, and a deflecting system with guides for deflecting the travelling block and the pipe elevator. The overlapping of the operations of running or pulling the drill pipes and the operations of their coupling and uncoupling is made possible owing to the incorporation of the system for lateral deflection of the travelling (tackle) block and elevator from the vertical axis of the borehole. The coaxial alignment of the travelling block and elevator with the borehole is provided for by rigid rail-type guideways mounted internally of the derrick parallel with the axis of the borehole and rigidly secured throughout their length from the crown pulley to the drilling platform. The existence of the two separate deflecting systems with their own drives, with power supply members movable through the entire height of the derrick, and with the necessity of controlling these systems, to say nothing of the relatively great weight and size of the guides and guideways, significantly steps up the weight of the entire unit and complicates its structure and operation. For these reasons, the known structure is illsuited for mobile handling units.

There is further known an apparatus (U.S. Pat. No. 2946464) for handling stands of drill pipes in the drilling of boreholes. The apparatus comprises a stationary derrick, a crown pulley, a split travelling or tackle block with a pipe elevator, a system of flexible guides (cables) for the travelling block and elevator, a platform for accommodating racked pipes and a turntable. Each flexible guide or cable is accommodated within the derrick and has its lower end fast with the platform and its upper end secured to the crown pulley through a power cylinder. For lifting and lowering the travelling block with the main elevator axially of the borehole, and for deflecting the elevator when the operations of running/pulling are made to overlap the operations of coupling/uncoupling, the system of flexible guides or cables is associated with the guide pulleys and trolleys of the travelling block, and of the main and transfer elevators. When the flexible guides or cables are tightened by operating the power cylinder, the main elevator is deflected from a pipe stand, and when the flexible guides or cables are released, the elevator turns, approaches a pipe stand and engages it.

In this apparatus of the prior art, partial overlapping of the running/pulling and coupling/uncoupling operations is attained. After a pipe stand is pulled from the borehole to a successive tool joint, the pipe string is supported by the turntable, while the travelling block with the elevator is run down the pipe to the level of the racking platform. Upon the elevator having engaged the lifted pipe under the joint, the flexible guides or cables of the travelling block are tightened, and the elevator is deflected from the pipe stand. With the above operations performed, the travelling block is run down the pipe, and the lifted pipe stand is uncoupled. With this operation also completed, the uncoupled pipe stand is lifted from the joint and racked. In re-running the stands of drill pipe into the borehole, the operations are reversed.

Hence, the apparatus of the prior art would not provide for complete superposition of the operations of running/pulling drill pipes with the operations of their coupling/uncoupling and moving into and out of the rack. When the travelling block is either lifted or lowered with the empty elevator, it is stopped, the upper end of a stand of drill pipe is re-engaged, the elevator is opened and closed, and the slips are applied and withdrawn, which takes considerable time and adversely affects the efficiency and productivity, while the complicated character of controlling the flexible guide (cable) system, the slips and the transfer elevator, and also of mounting/dismantling the apparatus at the mouth of a borehole practically prohibits the use of this known apparatus in mobile handling units which are supposed to be mounted/dismantled in relatively short periods, and their complexity of control should be minimized.

There is further known an installation for mechanization and in-part automation of pulling and running operations in the drilling of boreholes (U.S. Pat. Nos. 574517, 588340). The installation comprises a stationary derrick, a crown pulley, a split travelling (tackle) block with an elevator, and a centralizer with guides.

The overlapping of the operations is attained owing to the incorporation of the split travelling block with the closed automatic elevator rigidly suspended therefrom, which provides for lifting or lowering block with the elevator axially of the borehole without any additional operations, while passing therethrough either the drill pipe string or an uncoupled length of drill pipe. The upper end of the length of pipe or pipe stand during coupling/uncoupling is held by the centralizer which is supported by the brackets of the derrick for vertical reciprocation along flexible guides (cables) secured between the crown pulley and the bracket of the derrick strictly vertically, axially of the borehole. In this installation, the movement of the travelling block is effected with practically no interruptions, which significantly enhances the efficiency. This is attained, however, only when the centralizer and the rising path of the travelling block are completely axially aligned, as any disturbance of this strict co-axiality incurs the slower-down rate of the running/pulling operations and might even lead to emergencies.

As the travelling block is lifted either with the loaded elevator in pulling a pipe stand from the borehole, or with the empty elevator when the pipe string is run into the borehole, the housing of the rising travelling block at the height of the centralizer engages the latter's cone, whereafter they rise together. As the travelling block is susceptible to a certain degree of swinging in heavy winds, to say nothing of the eventual swinging of semisubmersed handling units of offshore installations, the path of the rising travelling block may become displaced from the axis of the borehole and of the centralizer.

In case of mobile handling units with an inclined mast, the disturbed axial alignment of the travelling block and centralizer can be caused by resilient deformation of the mast loaded by the pipe string. As the load is applied to the travelling block, the load is transmitted via the cable runs of the tackle to the crown pulley, displacing the latter laterally from the axis of the borehole in the mast inclination direction, thus altering the path of the movement of the travelling block from the mouth of the borehole towards the crown pulley. With the ends of the guides of the centralizer being fast with the brackets of the mast and rigidly secured under the crown pulley, and with the centralizer engaging the guides through the carriages for trolleys, the respective axes become displaced, and as the rising travelling block engages the centralizer, the former lifts the latter at the point of inflection of their intended path. The massive centralizer thus develops a tilting which is transmitted to the flexible guides, so that the centralizer could be eventually slanted and jammed. This interrups the operating sequence and may result in an emergency situation.

It can be seen that the last-described design of the prior art is suitable for conducting running and pulling operations exclusively in stationary drillig rigs. It is ill-suited for mobile handling units on account of the eventually disturbed axial alignment of the borehole, centralizer and path of the movement of the travelling block, variable in dependence on the weight of the pipe string. Should the above-described known technical solutions be implemented in mobile handling units, the efficiency would be drastically impaired. Furthermore, the flexible guides of the centralizer perform exclusively the guiding function, as the entire load of the centralizer being halted in its descent is taken up by the brackets of the derrick or mast. Indeed, in the course of running or pulling operations, as the travelling block runs down from its topmost position, the centralizer repeatedly sets itself upon the brackets of the derrick, and when the centralizer engages the bracket, it has the velocity and acceleration equalling the velocity and acceleration of the travelling block descending under the weight of the pipe string. This results in a dynamic impact with the load taken up by the bracket being many times as great as the weight of the centralizer, and this impact load is recurrent.

In a stationary drilling rig there are many ways of enhancing the strength and rigidity of the support brackets at the price of increasing the weight of the derrick and of the entire installation.

In mobile handling units, this capability is severely limited on account of the mass and rigidity of the mast being incomparably lower than in stationary rigs with their derricks.

Thus, the employment of the last-described structure of the prior art in mobile handling units is prohibited by the design of the guides of the centralizer, the increased mass and dimensions of the guides and their associated support members, the prolonged time of running and pulling operations. The use of this structure in mobile handling units is also irrational in view of eventual considerable downtime in well servicing, to say nothing of the time of mitigating eventual emergencies.

There is yet another known unit for handling operations at a borehole or well (U.S. Pat. No. 945630), comprising an inclined mast carrying a racking platform having a central opening at the side of the mast. The top part of the mast has secured thereto a crown pulley connected through hoist line cables to a split travelling (tackle) block, with an elevator suspended from the travelling block. The racking platform is adapted to support a centralizer with carriages for vertical reciprocation along guides in cooperation with the travelling block.

As the pipe string is pulled from the borehole, the elevator on the travelling block lifts the string, the travelling block rising to the level of the centralizer and engaging it, whereafter they continue rising jointly along the guides. The guides are flexible, secured between the racking platform and the crown pulley. With a threaded pipe joint of the string having emerged from the borehole, the movement of the travelling block is halted, the string is held at the mouth of the borehole, and the travelling block with the elevator is run down the pipe stand, with the pulled pipe being simultaneously uncoupled. As the travelling block descends to the level of the racking platform where the lowermost ends of the guides are secured, the centralizer sets itself on the platform, while the travelling block continues to descen. With the lifted pipe stand finally uncoupled, it is drawn laterally away from the travelling block and transferred onto the underpipe block, and the travelling block is raised with the successive engaged pipe stand.

With no load applied to the travelling block, the respective vertical axes of the crown pulley, travelling block and centralizer are aligned with the axis of the borehole, and the probability of matching engagement of the rising travelling block with the centralizer is fairly high. However, with the pipe string being pulled this co-axial alignment is disturbed. This is caused by the weight of the string in units of the described type being transmitted as a load through the hoist line cables to the mast. On account of definite flexibility of the mast, this causes an increase of the latter's angle of inclination, whereby the crown block is displaced laterally in the direction of inclination of the mast, the value of the angle of inclination in this case not being permanent, but depending on the load, i.e. on the length of the string being pulled. Consequently, as the pipe string is pulled, the crown pulley becomes offset from the borehole axis in the direction of the inclination of the mast, whereas the guides rigidly secured to the racking platform would not let the centralizer move in the direction of the displacement of the crown pulley in a horizontal plane. The displacement of the crown pulley leads to a changed path of rising of the travelling block and disturbed axial alignment of the travelling block and centralizer. As the travelling block is moved upwardly from the mouth of the borehole towards the crown pulley, it approaches the centralizer on the racking platform, and to ensure its matching engagement with the centralizer, the speed of the rising travelling block has to be slowed down to preclude an emergency situation. The matching engagement can be ensured by forced centering of the travelling block, i.e. by forced adjustment of the natural rising path of the travelling block from the borehole mouth to the crown pulley. However, the forced displacement of the travelling block disturbs the normal procedure of pulling operations, which incurs a substantial loss of time. In this way the efficiency of the handling unit is severely impaired.

Furthermore, in the descent of the travelling block with the centralizer, the setting of the centralizer on its stops on the racking platform involves recurrent dynamic impacts. As the descending centralizer engages the stops, it has a speed equalling the speed of the travelling block descending under the weight of the pipe string. Thus, at the moment of the setting of the centralizer onto its stops on the racking platform, the load caused by the moving weight of the centralizer is many times as great as the static load. Thus, each such setting is accompanied by violent vibration of the platform and of the entire mast structure, and the derrick man on the fourble board is made incapable of performing his functions.

Hence, the employment of the last-described known structure in mobile handling units is not practically feasible, as it prolongs the time of running and pulling operations, leads eventually to emergency situations, disturbs the normal operating procedure, and ultimately brings down the efficiency of the unit.

SUMMARY OF THE INVENTION

It is an object of the present invention to provide for cutting down the time of handling operations and enhancing the efficiency of the unit.

This and other objects are attained in a unit comprising an inclined mast having pivotally mounted thereon a racking platform with a central opening at the side of the mast, a crown pulley supported at the top of the mast, a split travelling block connected with the crown pulley through the hoist line cable, an elevator suspended from the travelling block, and a centralizer with carriages mounted for vertical reciprocation along guides in its cooperation with the travelling block, which unit, in accordance with the present invention, further comprises guideways for horizontal displacement of the centralizer, accommodated in the central opening of the racking platform symmetrically with respect to its axis for cooperation with the guides for vertical reciprocation of the centralizer, the guides being rigid, pivotally secured at the upper part of the mast and carrying stops intermediate the centralizer and the racking platform immediately above the latter, the centralizer being provided with sheaves for cooperation with the cables of the hoist line in movement therealong.

To provide for displacement of the centralizer horizontally to follow the varying path of the travelling block, it is expedient that each guideway for horizontal displacement of the centralizer should include a plate with a slot with an open end facing the mast, the end of the respective guide for vertical displacement being received in the slot for free displacement therealong.

To provide for rapid rearrangement of the unit and to expand its functional capabilities, it is alternatively expedient that each guideway for horizontal displacement of the centralizer should include a beam mounted for its introduction into and withdrawal from the central opening of the racking platform, cooperating with the bifurcated lowermost end of the respective guide for vertical reciprocation of the centralizer.

To provide for rapid rearrangement of the unit in its conversion from the working state to the transport state and vice versa, it is expedient that the centralizer should be associated with means for retaining it in its topmost position, and the mast should be provided with means for retaining the guides for vertical reciprocation of the centralizer.

To provide for performing handling operations with drill rods and for performing auxiliary operations in the drilling and servicing of boreholes ans wells, it is expedient that the unit should further comprise holders for suspension of drill rods, arranged symmetrically on the racking platform behind the guideways for horizontal displacement of the centralizer, each guideway for horizontal displacement of the centralizer being associated with means for its rotation in a vertical plane, and each guide for vertical reciprocation of the centralizer being associated with means for its pivoting, situated below the means for retaining the centralizer in its topmost position.

For conducting running and pulling operations by units of lesser load capacities, and also for handling single pipes, it may be expedient for each means for retaining the centralizer in its topmost position to be supported by the respective guide for vertical reciprocation of the centralizer.

Alternatively, for conducting running and pulling operations by units of greater load capacities, and also for handling pipe stands made of two or three single pipe lengths, it is expedient, for enhancing the operating routine, that each means for retaining the centralizer in its topmost position should be carried by respective carriage of the centralizer, each guide for vertical reciprocation of the centralizer having cooperating recesses made therein.

The disclosed invention provides for enhancing substantially the efficiency of the handling unit, and for simultaneous operations of running and pulling drill pipes and rods and their coupling and uncoupling. Moreover, the disclosed invention enhances the safety of the handling work, upgrades the durability and reliability of the handling unit, while providing for significantly reducing its weight and dimensions.

SUMMARY OF THE DRAWINGS

The present invention will be further described in connection with embodiments thereof, with reference being made to the accompanying drawings, wherein.

DESCRIPTION OF THE INVENTION

Figure 1:
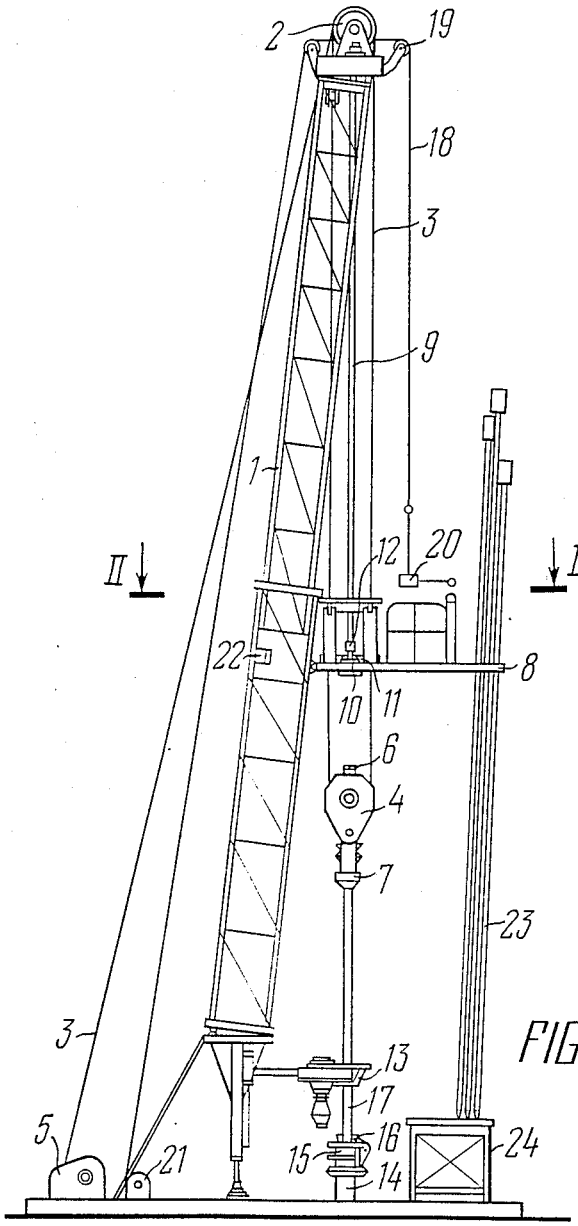
FIG. 1 shows schematically a general view of a unit for conducting running and pulling operations at a borehole or well, embodying the invention.

In the drawings, the handling unit for conducting running and pulling operations with drill rods or pipes at a borehole or well, constructed in accordance with the invention, comprises an inclined telescoping mast 1 having mounted at the top thereof a crown pulley 2 connected via the hoist line cable 3 with a split travelling (tackle) block 4. The hoist line 3 is run to the drum of a draw works 5. The split travelling block 4 carrying at the top thereof a male cone 6 has suspended therefrom a closed-contour elevator 7. Mounted pivotally on the mast 1 is a foldable racking platform 8. Rigid guides 9 pivotally mounted on the mast 1 at its upper portion have abutment stops 10 immediately above the racking platform 8. The stops 10 support thereon a reciprocable centralizer 11 mounted for vertical reciprocation along the guides 9 with the aid of carriages 12 provided on the centralizer 11. Mounted at the bottom of the mast 1 for limited vertical travel is a tongs 13 for coupling and uncoupling drill pipes and rods, and at the mouth 14 of a borehole (or a wellhead, as case may be) is arranged a spider 15 with slips or wedges 16 for clamping a drill pipe string 17 and holding it in a suspended state. An auxiliary cable 18 run about sheaves 19 mounted atop the mast 1 has its one end carrying a transfer elevator 20 for clamping and racking/unracking drill pipes, its other end being secured to the drum of an auxiliary winch 21. Means 22 for retaining the guides 9 of the centralizer 11 in a transport position are provided inside the mast 1. Drill pipes or pipe stands 23 pulled from the borehole or well are racked with their bottom ends resting on an underpipe block 24.

Figure 2:
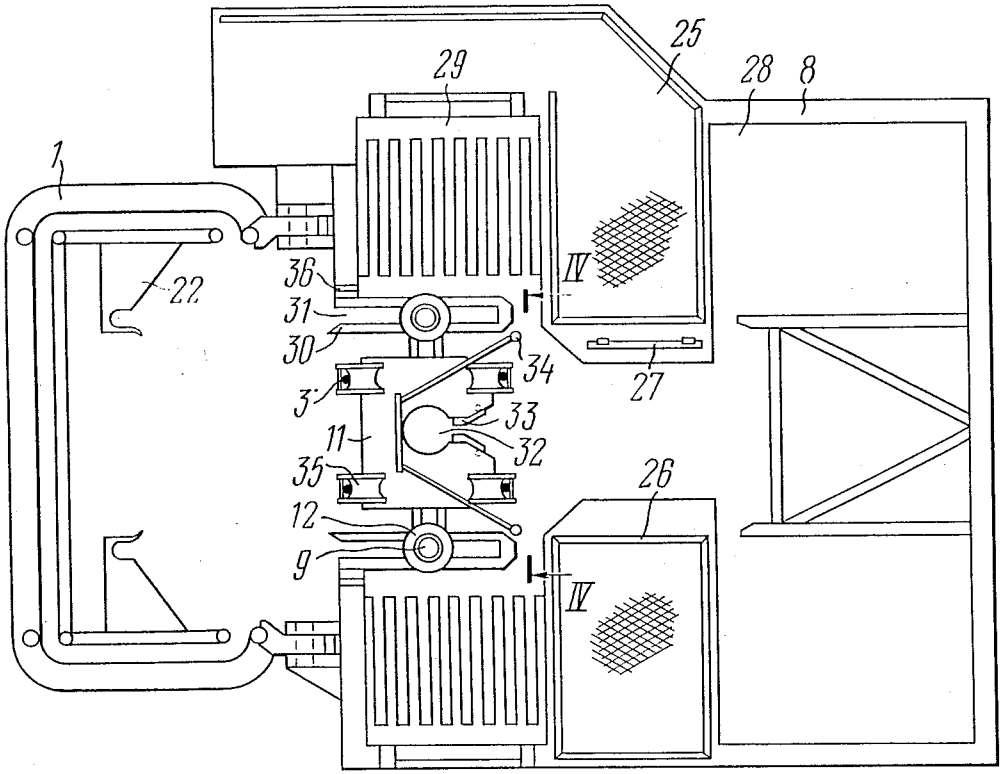
FIG. 2 shows on a larger scale in a plan view the centralizer and racking platform in a unit, embodying the invention.

The racking platform 8 (FIG. 2) of a rectangular shape with a central opening at the side of the mast 1 is provided with fourble boards 25 with an outside railing of hinged guards 26 and a swing-down bridge 27. The racking platform 8 supports thereon holders 28 for racked drill pipes and holders 29 for suspended drill rods. Mounted symmetrically at the opposite sides of the central opening of the racking platform 8 are parallel guideways 30 for horizontal displacement of the centralizer 11, intended for cooperation with the guides 9 for vertical reciprocation of the centralizer 11. Each guideway 30 for horizontal displacement of the centralizer 11 is in the form of a plate with a slot 31. The centralizer 11 is in the form of a plate with a through central opening 32 communicating with a slit with spring-urged latches 33 normally closing this slit of the centralizer 11, the slits 33 being associated with release handles 34. The centralizer 11 is provided with sheaves 35 for engagement with the cables of the hoist line 3.

Figure 3:
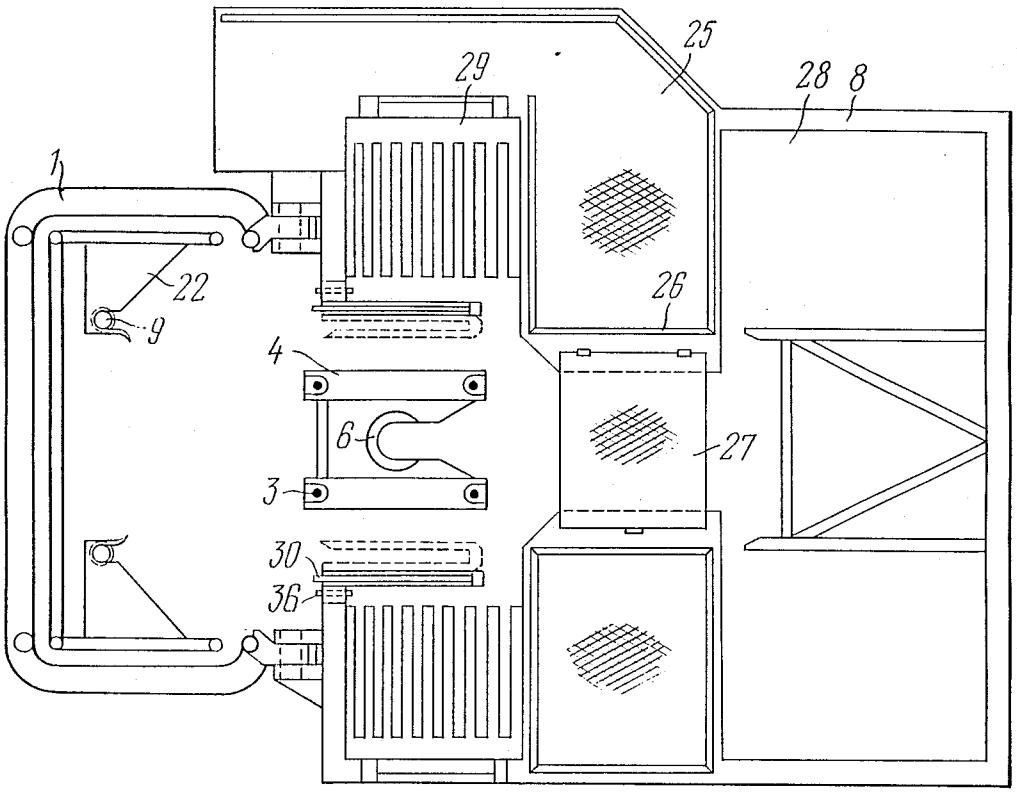
FIG. 3 shows on a larger scale in a plan view the racking platform in a unit, embodying the invention, prepared for drill rod handling.

For unobstructed passage of the travelling block 4 through the central opening of the racking platform 8 in running and pulling operations with drill rods, and also for performing the operations of stacking drill pipes and rods horizontally on ramps (not shown) or destacking them therefrom, the guides 30 for horizontal displacement of the centralizer 11 are provided with means 36 (FIGS. 2 and 3) for their rotation in a vertical plans.

Figure 4:
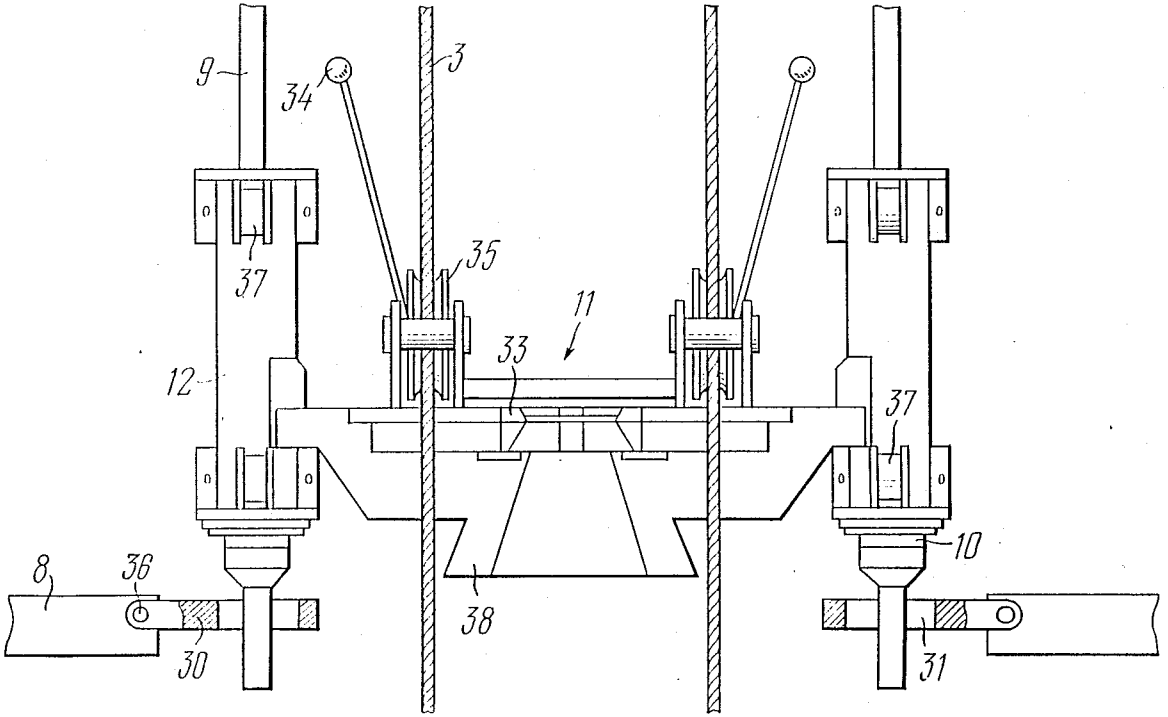
FIG. 4 is a sectional view taken on line IV—IV of FIG. 2.

The carriages 12 (FIG. 4) of the centralizer 11 are provided with clusters of rollers 37 for interaction with the vertical guides 9. Projecting downwardly from the plate of the centralizer 11 is a female (receiving) cone 38 for matching engagement with the male cone 6 (FIG. 1) of the travelling block 4.

Figure 5:
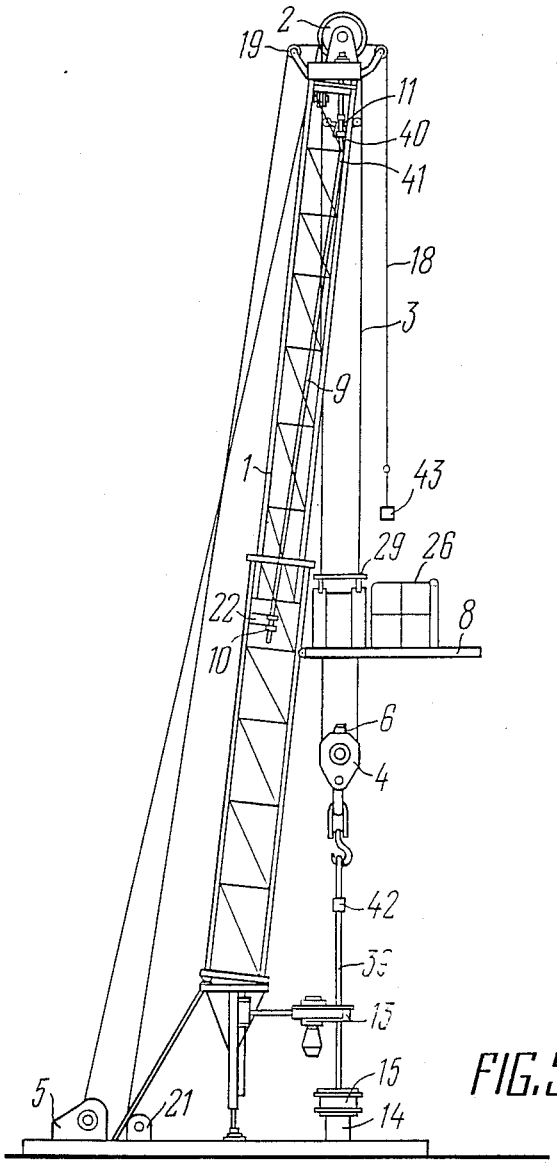
FIG. 5 is a general view of the same unit in its arrangement for handling drill rods, and for converting it into the transport state, in accordance with the invention.
Figure 6:
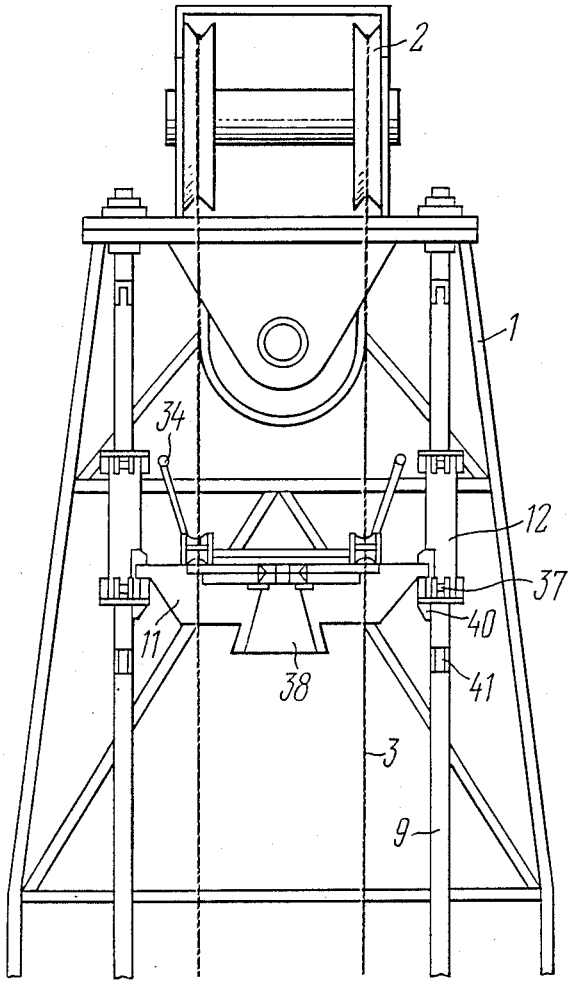
FIG. 6 is a sectional view taken on line V—V of FIG. 5.

When the handling unit being described is to be converted to the transport state, as well as in its operation with drill rods 39 (FIGS. 5, 6), the centralizer 11 has to be retained in its topmost position, for which purpose it is associated with appropriate retaining means 40, and the guides 9 for vertical reciprocation of the centralizer 11 are provided with means 41 for their pivoting in the direction of inclination of the mast 1. For operation with rods, a rod elevator 42 is suspended from the travelling block 4, and a rod transfer elevator 43 is connected to the free end of the auxiliary cable 18.

For conducting running and pulling operations with drill pipes 17 (FIG. 1) or rods 39 (FIG. 5) either racked vertically, or else stacked horizontally on ramps (not shown) and destacked therefrom, as well as for alternative arrangements of the herein-disclosed handling unit providing for its specific load capacity and manner of transportation, there is a version of the guideways 30 (FIG. 7) for horizontal displacement of the centralizer 11 in the form of beams mounted for being selectively moved into the central opening of the racking platform 8 and secured with locks 44, or withdrawn therefrom. In this embodiment, the guides 9 (FIG. 8) for vertical reciprocation of the centralizer 11 have their bottom ends 45 bifurcated for cooperation with the beams of the guideways 30.

Figure 9:
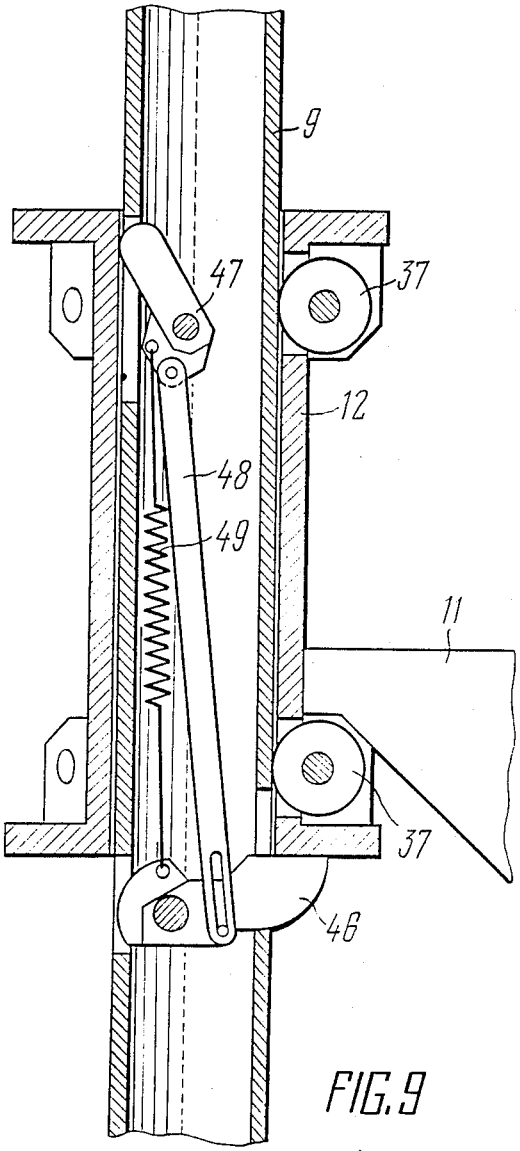
FIG. 9 illustrates on a larger scale one version of the means for retaining the centralizer, in accordance with the invention.

The means 40 (FIG. 5) for retaining the centralizer 11 in its topmost position, provided on at least one of the two guides 9 for vertical reciprocation of the centralizer 11 includes a latch 46 (FIG. 9) extending into the interior of the respective guide 9 and a follower arm 47, articulated with an arm 48 and urged by a spring 49. The latch 46 and follower arm 47 are intended for cooperation with the respective carriage 12 of the centralizer 11 when it moves along its guide 9 for vertical reciprocation of the centralizer 11.

Figure 10:
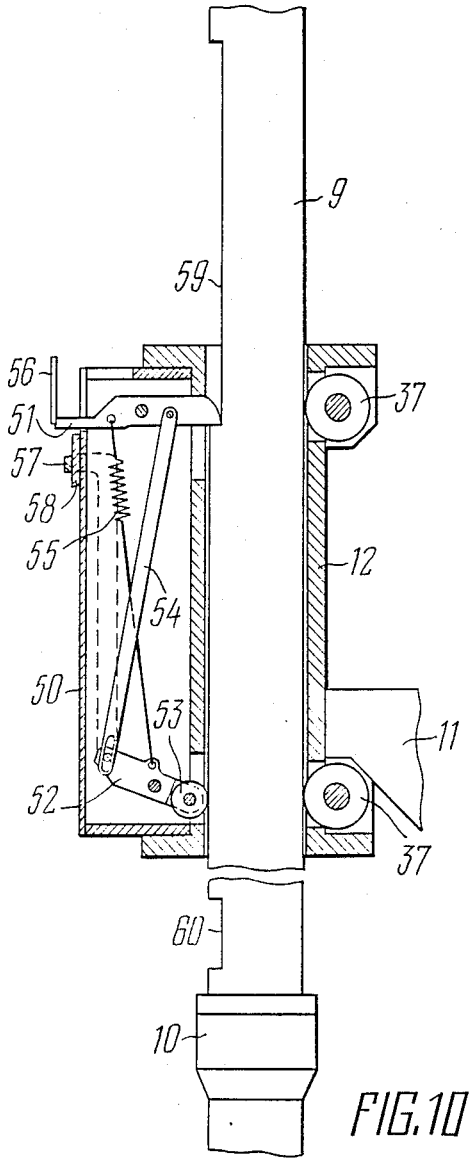
FIG. 10 illustrates, also on a larger scale, another version of the means for retaining the centralizer, in accordance with the invention.

In another embodiment, the means 40 (FIG. 5) for retaining the centralizer 11 in its topmost position, provided on at least one carriage 12 of the centralizer 11, includes a housing 50 (FIG. 10) having pivotally mounted therein a catch 51 and an arm 52 with a follower 53, interconnected by an arm 54 and urged by a spring 55. For monitoring the position of the latch 51 of this embodiment, it carries on its distal end a tab 56, and for disabling the retaining means 40 in normal handling operations, it is provided with a lever 57 that can be caught beneath a stop 58. In this embodiment, the respective guide 9 for vertical reciprocation of the centralizer 11 has recesses 59 and 60 made therein for cooperation with the means for retaining the centralizer 11 by its respective carriage 12.

Figure 11:
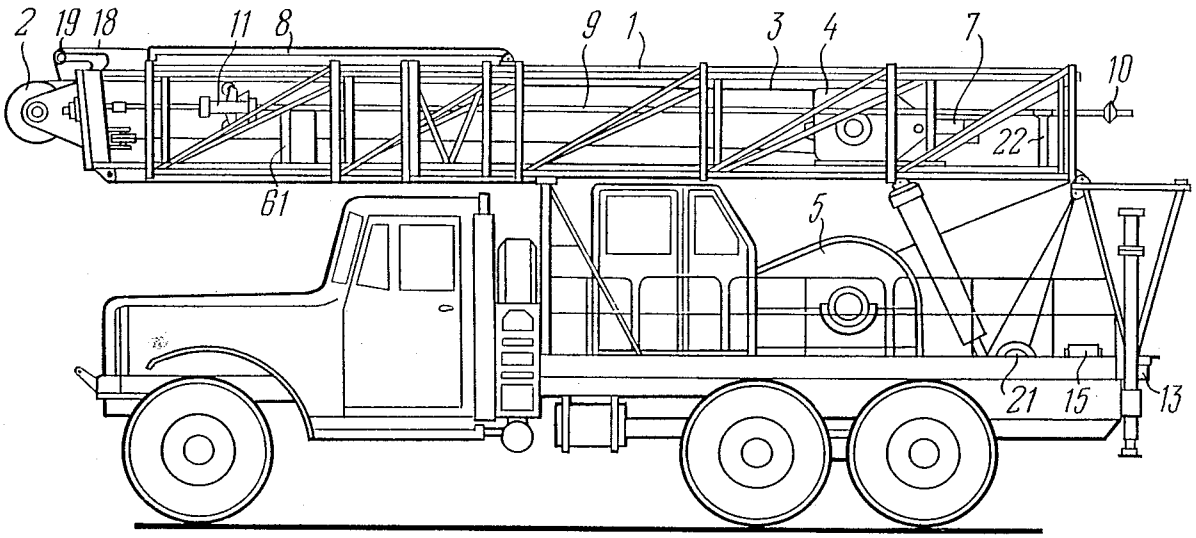
FIG. 11 shows the general view of the disclosed handling unit in its transport state.

In one mobile embodiment of the disclosed handling unit, illustrated in FIG. 11, the guides 9 for vertical reciprocation of the centralizer 11 are secured in the transport state of the units by the retaining means 22 and rest on props 61.

The disclosed unit for conducting running and pulling operations at a borehole or well is operated, as follows.

The elevator 7 (FIG. 1) suspended from the split travelling block 4 engages the pipe string 17 under a joint, and the draw works 5 is operated to hoist the pipe string 17. The load of the latter's weight is transmitted via the travelling block 4 and hoist line cable 3 to the crown pulley 2 atop the inclined mast 1. This load causes an increased angle of inclination of the mast 1, with the crown pulley 2 being displaced laterally from the axis of the borehole (with which it is initially aligned). Consequently, the path of the travelling block 4 rising from the borehole mouth 14 (or the wellhead, as case may be) towards the crown pulley 2 is deflected from the axis of the borehole.

As the centralizer 11 (FIG. 2) is resting on the stops 10 of the pivotally mounted rigid guides 9 for vertical reciprocation of the centralizer 11, having their lowermost ends received for free displacement in the slots 31 of the respective plate-shaped guideways 30 for horizontal displacement of the centralizer 11, the varying angle of inclination of the mast 1 (FIG. 1) and the resulting lateral displacement of the axis of the crown pulley 2 from the axis of the borehole under the weight of the pipe string 17 cause the centralizer 11 shift accordingly in the horizontal plane. As the sheaves 35 (FIG. 2) of the centralizer 11 keep the latter in engagement with the respective cables of the hoist line 3 the centralizer 11 becomes automatically positioned precisely at the path of the travelling block 4 (FIG. 1) rising from the mouth 14 of the borehole towards the crown pulley 2. Thus, owing to the centralizer 11 being mounted both for vertical reciprocation along the rigid pivotally secured guides 4 and for horizontal displacement along the guideways 30 (FIG. 2), and also owing to the centralizer 11 engaging the hoist line cable 3 by its sheaves 35, the alignment of the respective axes of the travelling block 4 (FIG. 1), centralizer 11 and crown pulley 2 is maintained regardless of the value of lateral displacement of the crown pulley under the varying load of the weight and resistance of the pipe string 17 being hoisted or pulled. This self-alignment of the axes of the travelling block 4, centralizer 11 and crown pulley 2 ensures accurate mating engagement of the male cone 6 of the travelling block with the receiving cone 38 (FIG. 4) of the centralizer 11, however severe the swinging of the travelling block 4 (FIG. 1) could be.

To suit different specific intended applications of the disclosed handling unit, its load capacity and manner of transportation, there have been described alternative versions of the guideways 30 for horizontal displacement of the centralizer 11. In the first-described version, the guideways 30 (FIG. 2) for vertical displacement of the centralizer 11 are in the form of plates having each a slot 31 facing by its open end the mast 1, the lowermost ends of the guides 9 for vertical displacement of the centralizer 11 being received in these respective slots 31 for free displacement therealong.

In the other version, the guideways 30 (FIG. 7) for horizontal displacement of the centralizer 11, made in the form of beams, cooperate with bifurcated lowermost ends 45 (FIG. 8) of the respective guides 9 for vertical reciprocation of the centralizer 11.

Thus, as the split travelling block 4 (FIG. 1) is hoisted jointly with the elevator 7 and pipe string 17, it rises to the level of the racking platform 8 and contacts the centralizer 11 positively brought to the path of the rising travelling block 4, as it has been already described. The cone 6 of the travelling block engages matchingly the receiving cone 38 (FIG. 4) of the centralizer 11, and the travelling block 4 continues rising jointly with the centralizer 11. The latter is riding a top the travelling block 4 along the guides 9 for vertical reciprocation of the centralizer 11.

Upon a successive joint of the pipe string 17 having emerged from the mouth 14 (FIG. 1) of the borehole, the hoisting of the travelling block 4 is halted, the pipe string 17 is held by the slips 16 of the spider 15, and the travelling block 4 with the elevator 7 is run down. The centralizer 11 descends atop the split travelling block 4 along the guides 9. The very pipe or pipe stand 23 pulled from the borehole serves as the guide for the downward travel of the travelling block 4, extending first through the descending travelling block, and then through the central opening 32 (FIG. 2) of the centralizer 11.

Upon the travelling block 4 (FIG. 1) with the centralizer 11 having descended to the level of the racking platform 8, the centralizer sets itself on the stops 10 of the guides 9 for vertical reciprocation of the centralizer 11, immediately above the racking platform 8, while the travelling block 4 continues its independent downward travel along the pipe or pipe stand 23. When the centralizer 11 sets itself on the stops 10 of the guides 9, the entire load caused by the impact and weight of the centralizer 11 is transmitted through the rigid guides 9 to the crown pulley 2 and mast 1, positively precluding vibration of the racking platform 8 where the derrick man works in the course of handling operations.

While the split travelling block 4 descends, the upper end of the pipe 23 hoisted from the borehole is retained at the top by the closed latches 33 (FIG. 2) of the centralizer 11. Simultaneously with the downward travel of the travelling block 4, the hoisted pipe or pipe stand 23 (FIG. 1) is uncoupled by the operation of the tongs 13. With the uncoupling completed, the tongs 13 is moved into its down position. The elevator on the travelling block 4 lowers to underlie the successive joint of the pipe string 17 and stops. The man on the racking platform 8 operates the transfer elevator 20 to engage the uncoupled pipe 23 and lifts it by activating the auxiliary winch 21. Then he operates the release handles 34 (FIG. 2) to open the catches 33 of the centralizer 11, and moves the lifted pipe 23 (FIG. 1) or pipe stand beyond the centralizer 11 and travelling block 4. The travelling block 4 and elevator 7 is hoisted with the pipe string 17, i.e. the successive pipe or pipe stand is pulled in the above-described procedure. Meanwhile the derrick man sets the previously lifted pipe or pipe stand by its lowermost end on the underpipe block 24 and racks it in the pipe holder 28 (FIG. 2) on the racking platform 8.

Then the above-described pulling and racking cycle is repeated.

For running in a pipe string, the derrick man operates the transfer elevator 20 (FIG. 1) to lift a racked pipe or pipe stand and to move it into the central opening 32 (FIG. 2) of the centralizer 11, with the spring-urged catches 33 letting the pipe enter the central opening 32 and returning into their normal position, closing the central opening 32. The derrick man operates the auxiliary winch 21 (FIG. 1) to lower the joint end of the pipe or pipe stand into the joint of the preceding pipe run into the borehole and held by the spider 15, whereafter he releases the transfer elevator 20, and the pipe or pipe stand is held vertically by the centralizer 11. The travelling block 4 is hoisted, with the elevator 7 automatically bypassing the joint and moving upward along the vertically held pipe. The travelling block 4 with the elevator 7 suspended therefrom rises to the level of the centralizer 11, engages its receiving cone 38 (FIG. 4) and continues rising, carrying the centralizer 11 (FIG. 1).

While the travelling block 4 and elevator 7 are thus rising, the tongs 13 are set in its operating position above the joint, and the held pipe is coupled.

With the coupling of the pipe in the joint of the pipe string 17 completed, the elevator 7 engages the pipe string by its upper joint and slightly lifts it. The slips 16 of the spider 15 release the pipe string 17, and the latter is run into the borehole. As the travelling block 4 descends, the centralizer 11 sets itself onto the stops 10 of the guides 9 at the level of the racking platform 8, and the travelling block 4 with the elevator 7 descends into its downmost position, whereafter the pipe string 17 is clamped by the spider 15. Meanwhile the derrick man prepares the next pipe or pipe stand for running into the borehole.

Then the above-described deracking and running cycle is repeated.

Drill rods are run or pulled in the disclosed handling unit in a similar procedure.

The retaining of the centralizer 11 in its topmost position depends on the operating conditions of the handling unit and the manner of its transportation.

The means 40 (FIG. 5) for retaining the centralizer 11 in its topmost position, as it has been already described, can be mounted either on the guides 9 (FIG. 9) for vertical reciprocation of the centralizer 11, or else on the respective carriages 12 (FIG. 10) of the centralizer 11, with corresponding cooperating recesses 59 and 60 provided in the guides 9. The centralizer 11 is retained in its out-of-work zone, at the top of the mast 1 (FIG. 1).

The means 40 (FIG. 9) for retaining the centralizer 11, mounted on the respective guides 9 for vertical reciprocation of the centralizer 11, are operated in the following manner.

The centralizer 11 (FIG. 6) is lifted by the travelling block 4 into its topmost out-of-work retaining zone. The carriage 12 (FIG. 9) of the centralizer 11 rising along the respective guide 9 operates the latch 46, making it pivot into the guide 9, and continues rising along the guide 9. As the carriage 12 of the centralizer 11 rises above the latch 46, the centralizer 11 is halted. The effort of the spring 49 returns the latch 46 into its normal "hold" position, projecting outwardly from the guide 9. The travelling block 4 (FIG. 1) with the centralizer 11 rising atop it is run down; the carriage 12 sets itself onto the latch 46 (FIG. 9) and stops, and the travelling block 4 (FIG. 1) continues its descent. In this manner the centralizer 11 (FIG. 6) is retained in its topmost position.

Now, to lower the centralizer 11 into its operating position, it is first slightly lifted above the level of the follower arm 47 (FIG. 9) which, upon the carriage 12 clearing it, is returned by the effort of the spring 49 into its normal horizontal position. Then the centralizer 11 is run down atop the travelling block 4. The descending carriage 12 engages and operates the follower arm 47, pivoting it down. This pivoting of the follower arm 47 actuates the arm 48 which, in its turn, pivots the catch 46 into its retracted position inside the guide 9, clearing the way for the descending carriage 12. Thus, the carriage 12 descends unobstructedly below the catch 46, and the centralizer 11 runs down along the guides 9, while the spring 48 returns the follower arm 47 and catch 46 into their respective normal positions.

In another version, the means 40 (FIG. 10) for retaining the centralizer 11 is in the form of an integral unit in the housing 50 mounted on the respective carriage 12 for easier operation. To prevent the interaction of the catch 51 and follower arm 52 with the respective guide 9 in the course of handling operations, they are retracted towards each other into the housing 50 by pressing down the lever 57 and catching it under the stop 58. In this state of the retaining means, the centralizer 11 unobstructedly moves up and down the guides 9.

To retain the centralizer 11 in its topmost position, it is set on the stops 10 of the guides 9, and the lever 57 is moved from under the stop 58 and released, whereby the effort of the spring 55 urges the catch 51 and follower arm 52 towards their normal positions, with the catch 51 abutting against the guide 9, and the follower arm 52 with the follower 53 entering the lower recess 60, turning and assuming a horizontal position. Now, the centralizer 11 is lifted to the topmost position, the catch 51 and follower arm 52 rising in engagement with the periphery of the guide 9. As soon as the catch 51 reaches the level of the upper recess 59, it is turned by the effort of the spring 55 into a horizontal position, entering the recess 59. Then the travelling block 4 (FIG. 1) carrying thereon the centralizer 11 is run down, the catch 51 (FIG. 10) abutting against the shoulder of the recess 59, thus fixing the centralizer 11 on the respective guide 9, while the travelling block 4 (FIG. 1) descends further down. The above-described operation of the retaining means 40 (FIG. 10) of this embodiment is monitored by the tab 56 attached to the distal end of the catch 51.

Now, to lower the centralizer 11 into its operating position, it is first somewhat lifted until the arm 52 with the follower 53 tracing the periphery of the respective guide 9 enters the zone of the recess 59 and pivots into its horizontal position. Then the centralizer 11 is run down atop the travelling block 4 (FIG. 1). In this downward motion, as the follower 53 on the follower arm 52 (FIG. 10) runs onto the shoulder of the recess 59, it pivots upwardly, this pivoting pulling down the arm 54 to move the catch 51 into the housing 50, disengaging it from the guide 9. The centralizer 11 now descends unobstructedly along the guides 9. For normal handling routine, the lever 57 is caught under the stop 58, locking the catch 51 and follower arm 52 in their disengaged positions.

As it has been already mentioned, for performing the jobs associated with stacking drill pipes and rods horizontally on ramps (not shown), or destacking them therefrom, as well as for performing accelerated handling jobs with drill rods 39 (FIG. 5), the guides 9 for vertical reciprocation of the centralizer 11 are provided with the means 41 for their folding, situated under the means 40 for retaining the centralizer 11 in its topmost position and allowing to pivot the lower parts of the guides 9 in the direction of inclination of the mast 1.

To perform various auxiliary jobs that could be called for in the drilling and servicing of boreholes and wells, the equipment of the herein-disclosed handling unit can be rearranged, as follows.

Figure 7:
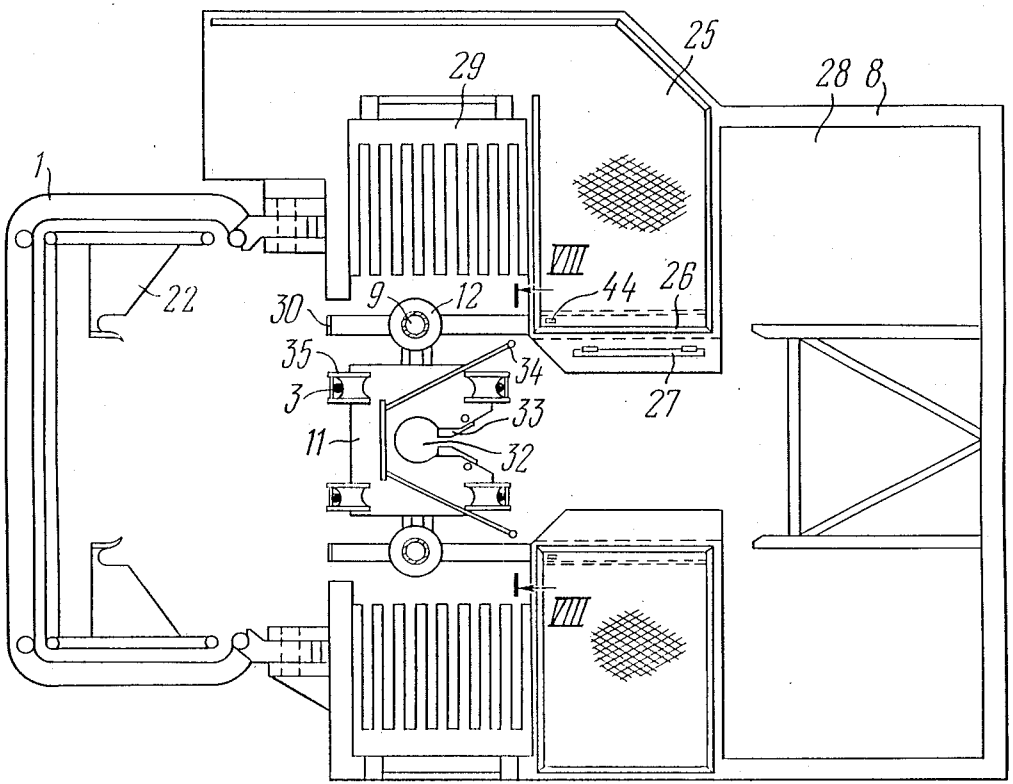
FIG. 7 illustrates on a larger scale in a plan view the racking platform with an alternative structure of the guideways for horizontal displacement of the centralizer, in accordance with the invention.
Figure 8:
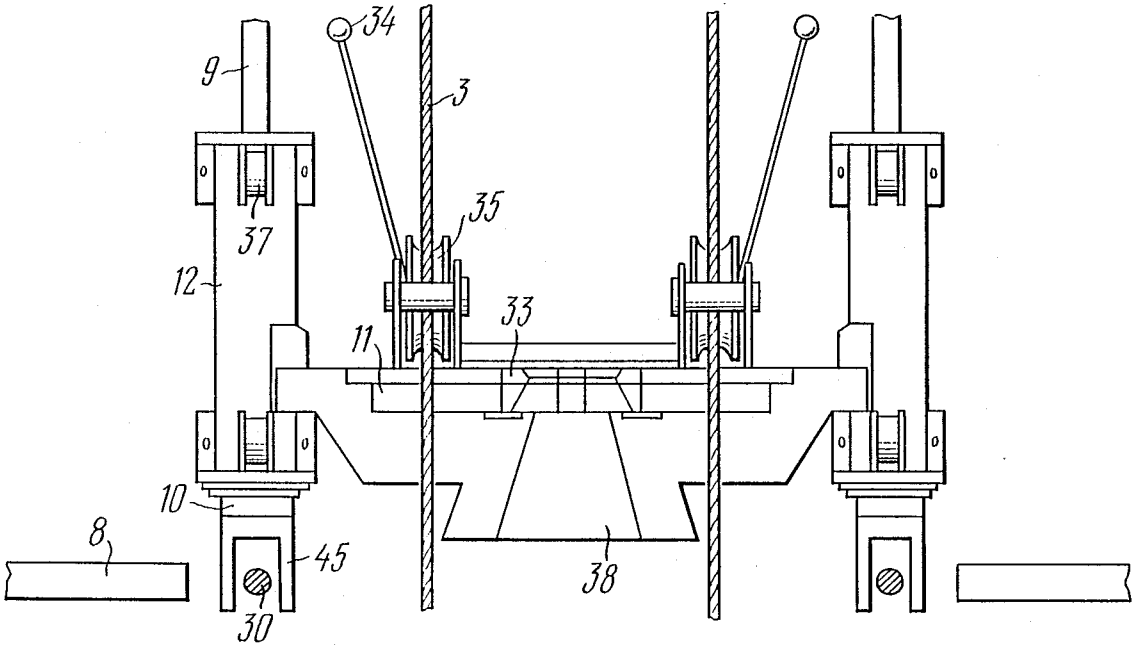
FIG. 8 is a sectional view taken on line VI—VI of FIG. 7.

With the aid of the travelling block 4, the centralizer 11 is locked in its topmost position by the retaining means 40, the lowermost ends of the guides 9 pivoted into the mast 1 are fixed by the retaining means 22, and the guideways 30 (FIG. 2) for horizontal displacement of the centralizer 11, in the form of plates with the respective slots 31, are pivoted in a vertical plane with the aid of their pivoting means 36. When the guideways 30 are in the form of beams, as shown in FIG. 7, they are withdrawn from the central opening of the racking platform 8 to underlie the respective fourble boards 25.

In this rearranged state the disclosed unit is operable for auxiliary jobs of horizontally stacking drill pipes and rods on ramps (not shown) or destacking them from the ramps for running back into the borehole or well, of replacing individual pipes or rods in a maintenance procedure, of conducting running and pulling operations with drill rods at higher speeds; moreover, it is in this rearranged state that the disclosed unit is converted for transportation when it is mounted on a carrier vehicle, without any additional mounting or dismantling work.

Drill rods are run in or pulled at an accelerated rate in the following manner.

The elevator 42 (FIG. 5) for drill rods 39, suspended from the travelling block 4, engages the string of the rods 39 by a joint and pulls it from the bore-hole or well. With the central opening of the racking platform 8 having been made free from the vertical guides 9 and guideways 30 (FIG. 2), as described hereinabove, and the centralizer 11 (FIG. 5) having been retained in its uppermost position, the travelling block 4 passing through the central opening of the racking platform 8 is saved from any possible contact with the platform 8, whatever the degree of swinging or displacement of the travelling block 4 in operation. When the travelling block 4 is risen above the zone of the platform 8 and a successive joint of the drill rods 39 emerges from the borehole, the rising of the travelling block 4 is halted and the string of rods 39 is clamped by the spider 15. The derrick man engages the transfer elevator 43 on the lifted rod 39 and releases the main rod elevator 42. The travelling block 4 with the main rod elevator 42 is run down, and simultaneously the lifted rod 39 is uncoupled. As soon as operation is completed, the main elevator 42 is operated to engage the successive rod 39, while the derrick man operates the transfer elevator 43 to lift the uncoupled rod 39 and move it away from the zone of the travelling block 4. The latter is operated to lift the next rod 39, while the derrick man racks the lifted rod 39 in the holder 29 on the racking platform 8. Then the above-described sequence is repeated.

Drill rods 39 are run into a borehole or well in a reversed sequence.

Thus, in addition to running and pulling operations of the major kind, with the running/pulling operations overlapping with the coupling/uncoupling operations, the disclosed unit, after minor rearrangements, is operable for other jobs associated with the drilling and servicing of boreholes and wells. The rearrangement requires no substantial input of time and labor, no mounting or dismantling of additional equipment. Besides, it is in this rearranged state that the disclosed unit is converted for transportation.

The present invention is intended for conducting running and pulling operations at a borehole or well, and is embodied in a handling unit operable with both stationary derricks and inclined masts in the drilling and servicing of boreholes and wells. The unit can be of various capacities and can be mounted on carrier vehicles. The novel technical solution offered by the present invention allows to enhance significantly the efficiency of the handling unit and provides for complete superposition of the rod and pipe running/pulling operations upon their coupling/uncoupling and deracking/racking operations owing to positive alignment of the respective axes of the travelling block 4 (FIG. 1) and centralizer 11. The positive alignment of the axes of the travelling block 4 and centralizer 11 is attained owing to the centralizer 11 being mounted both for vertical reciprocation along the guides 9 and horizontal displacement along the guideways 30 (FIG. 2), i.e. simultaneously in the vertical and horizontal planes, while following the cables of the hoist line 3 in engagement therewith. With the centralizer 11 being supported by the rigid vertically arranged pivotable guides 9, it can shift freely in a horizontal plane along the guideways 30 for its horizontal displacement, while the engagement of the centralizer 11 with the hoist line 3 provides for guaranteed matching engagement of the travelling block 4 (FIG. 1) with the centralizer 11, whatever the displacement of the travelling block 4 laterally under the varying load of the weight and resistance of the pipe string 17. Moreover, with the centralizer 11 setting down upon the stops 10 of the guides 9 for its vertical reciprocation, dynamic impacts that could cause vibration of the racking platform 8 accommodating the derrick man are avoided, thus enhancing the working safety and adding to the durability and reliability of the unit, while providing for significantly reducing its weight and overall dimensions.

The disclosed structural features of the unit for conducting running and pulling operations and of its individual components require neither additional power supply members nor additional controls, while providing for quick and uncomplicated rearrangement of the unit for performing auxiliary operations and jobs associated with the drilling and servicing of boreholes or wells, as well as for reducing the time of converting the unit to the transport state. The uncomplicated rearrangement procedure calls neither for substantial input of time and labor, nor for performing any additional mounting or dismantling work.

The disclosed novel technical solution and its essential novel features can be implemented in the presently manufactured handling units for drilling and servicing boreholes and wells, without introducing any major changes into their principal design.

What is claimed is:

1. A unit for borehole running and pulling operations with drill rods or pipes, comprising:

an inclined mast;

a racking platform pivotally mounted on said inclined mast;

said racking platform having a central opening at the side of said inclined mast;

a crown pulley supported at the top of said inclined mast;

a split travelling block connected with said crown pulley;

an elevator suspended from said split travelling block;

cables of a hoist line connecting said split travelling block with said crown pulley;

a centralizer mounted intermediate said racking platform and said crown pulley for vertical reciprocation together with and for interaction with said split travelling block;

sheave means of said centralizer adapted for cooperation with said cables of said hoist line in the movement of said centralizer therealong;

guides for vertical reciprocation of said centralizer in its interaction with said travelling block, pivotally mounted at the upper part of said inclined mast, said guides being rigid;

carriage means mounted on said centralizer for its interaction with said guides for vertical reciprocation of said centralizer;

stop means on said guides for vertical reciprocation of said centralizer, situated intermediate said racking platform and centralizer, immediately above the racking platform for fitting said centralizer;

guideways for horizontal displacement of said centralizer, accommodated in said central opening of said racking platform symmetrically with respect to the axis thereof, for cooperation with respective ones of said guides for vertical reciprocation of said centralizer.

2. A unit for borehole running and pulling operations with drill rods or pipes, as set forth in claim 1, wherein each said guideway for horizontal displacement of said centralizer includes a plate with a slot having its open end facing said inclined mast, the lowermost end of the respective one of said guides for vertical reciprocation of said centralizer being received in said slot for free displacement therealong.

3. A unit for borehole running and pulling operations with drill rods or pipes, as set forth in claim 1, wherein each said guideway for horizontal displacement of said centralizer includes a beam mounted for introduction into and withdrawal from said central opening of said racking platform, for cooperation with a bifurcated lowermost end of the respective ones of said guides for vertical reciprocation of said centralizer.

4. A unit for borehole running and pulling operations with drill rods or pipes, as set forth in claim 1, wherein said centralizer is associated with means for retaining it in the upper part of said inclined mast, under said crown pulley, said inclined mast being provided with means for retaining said guides for vertical displacement of said centralizer.

5. A unit for borehole running and pulling operations with drill rods or pipes, as claimed in claim 4, comprising holders for suspension of drill rods, arranged symmetrically on said racking platform behind said guideways for horizontal displacement of said centralizer, each said guideway for horizontal displacement of said centralizer being provided with means for its rotation in a vertical plane, and each said guide for vertical reciprocation of said centralizer being provided with means for its pivoting, underlying said means for retaining said centralizer.

6. A unit for borehole running and pulling operations with drill rods or pipes, as set forth in claim 4, wherein said means for retaining said centralizer is carried by the respective one of said guides for vertical reciprocation of said centralizer.

7. A unit for borehole running and pulling operations with drill rods or pipes, as set forth in claim 4, wherein said means for retaining said centralizer is carried by the respective one of said carriages of said centralizer, with cooperating recesses made in the respective one of said guides for vertical reciprocation of said centralizer.

* * * * *